US008753218B2

(12) United States Patent
Suchanek

(10) Patent No.: US 8,753,218 B2
(45) Date of Patent: Jun. 17, 2014

(54) GOLF COURSE FOR PLAYING ON AT NIGHT

(76) Inventor: Martin Suchanek, Winterberg (CH)

( * ) Notice: Subject to any disclaimer, the term of this patent is extended or adjusted under 35 U.S.C. 154(b) by 0 days.

(21) Appl. No.: 13/821,980

(22) PCT Filed: Sep. 6, 2011

(86) PCT No.: PCT/EP2011/065377

§ 371 (c)(1),
(2), (4) Date: Apr. 2, 2013

(87) PCT Pub. No.: WO2012/032037

PCT Pub. Date: Mar. 15, 2012

(65) Prior Publication Data

US 2013/0210534 A1 Aug. 15, 2013

(30) Foreign Application Priority Data

Sep. 7, 2011 (CH) ..... 1455/10

(51) Int. Cl.
*A63B 57/00* (2006.01)

(52) U.S. Cl.
USPC ..... 473/176; 473/169

(58) Field of Classification Search
USPC ..... 473/100, 131, 157–176, 180, 181, 185, 473/195–197
See application file for complete search history.

(56) References Cited

U.S. PATENT DOCUMENTS 2,694,573 A * 11/1954 Walker ..... 315/151
3,918,719 A * 11/1975 Welch ..... 473/409
4,489,669 A * 12/1984 Carman ..... 116/202
5,265,875 A * 11/1993 Fitzgerald ..... 473/169
5,354,052 A * 10/1994 Nicholls et al. ..... 473/192
5,445,373 A 8/1995 Franks
5,685,780 A * 11/1997 Desjardins ..... 473/178
6,099,139 A * 8/2000 Lapensee ..... 362/153.1
6,569,028 B1 * 5/2003 Nichols et al. ..... 473/192
7,594,859 B2 * 9/2009 Mullen ..... 473/176
8,187,113 B2 * 5/2012 Lim ..... 473/176
2002/0159275 A1 * 10/2002 Nicholls et al. ..... 362/559
2003/0004006 A1 1/2003 Szymanski (Continued)

OTHER PUBLICATIONS

International Search Report of PCT Application No. PCT/EP2011/065377.

*Primary Examiner* — Mark Graham
(74) *Attorney, Agent, or Firm* — CUSPA Technology Law Associates; Yi Li

(57) ABSTRACT

This golf course includes a fairway (11), tees (17), greens (1), holes (3) and bunkers (4), and other customary obstacles (6). As a particular feature, it has a special lighting arrangement, such that it also allows golf to be played during hours of darkness. To this end, at least the tees (17), the greens (1), the bunkers (4) and obstacles (6) are each equipped with a series of discrete or continuous light sources (12, 15, 18, 20, 36), preferably in the form of ground-installed LEDs or of OLEDs or LEDs. These lights extend along the edges of the objects in question and are installed flush with the ground. The holes (3) are illuminated internally by means of a light source, and the flagpoles (24) are designed as removable illuminating poles, such that the hole (3) remains lit even after removal of the flagpole. On a golf course equipped in this manner, the game of golf is played with an illuminating golf ball. The length of time it is possible to play on a golf course is extended substantially, and a highly attractive ambience is created on the course.

20 Claims, 5 Drawing Sheets

(56) References Cited

U.S. PATENT DOCUMENTS

2004/0083633 A1* 5/2004 Mueller ..... 40/541
2004/0220001 A1* 11/2004 Oister et al. ..... 473/570
2008/0004139 A1* 1/2008 Jang ..... 473/481
2010/0004068 A1* 1/2010 Adame ..... 473/176
2010/0160057 A1 6/2010 Willett

* cited by examiner 2
3
10
11
1
10
6
7
5
4
10
9
10
8
11
13

GOLF COURSE FOR PLAYING ON AT NIGHT

This invention pertains to a golf course that is designed and equipped in such a way that it can be played on even at twilight and at night.

Conventionally, golf is only played during daylight. The golf player orients himself optically and for that he must be able to recognise the holes, bunkers and all the obstacles with his eyes. As soon as twilight sets in, it gets more difficult and then a point is reached when one has to abort the game. In many latitudes, twilight sets in earlier depending on the time of the year. But comfortable temperatures nevertheless prevail, so that lingering on the golf course would be attractive if not for the darkness. An obvious solution is to plunge the entire golf course in flood lights. This is practised effectively. However this solution is expensive and a lot of electrical energy is required. On the other hand, the light produced is an artificial light that is glaring and harsh. However it is important for the purpose to be achieved when one wants to recognise the targets and obstacles sufficiently clearly and with a sharp focus. A golf course equipped with flood lights is however a very rare occurrence. Almost all golf courses are only played on during daylight. If they could also be played on at night, significant additional revenues could be realised and many employed people could indulge in their sport in the evenings even when night has long set in. Moreover, the attractiveness of the golf course and the sport of golf would significantly increase due to the possibility of playing even in darkness.

The aim of the present invention is therefore to establish a golf course which can be played on during faltering daylight, twilight and at night, and which enables sufficient detection of the target areas and obstacles with low energy requirements.

This problem is resolved by a golf course with golf lawns, teeing grounds, greens with holes and flagpoles, bunkers and other usual obstacles wherein the course is distinguished thus—at least the teeing grounds, green, bunkers and obstacles are equipped with a series of discrete or continuous light sources which extend along their boundaries and are flush with the ground, the flagpoles are designed as luminous poles and the holes are lit internally by means of a light source.

The golf course is illustrated in the example in the figures and is described in detail below.

Figure 1:
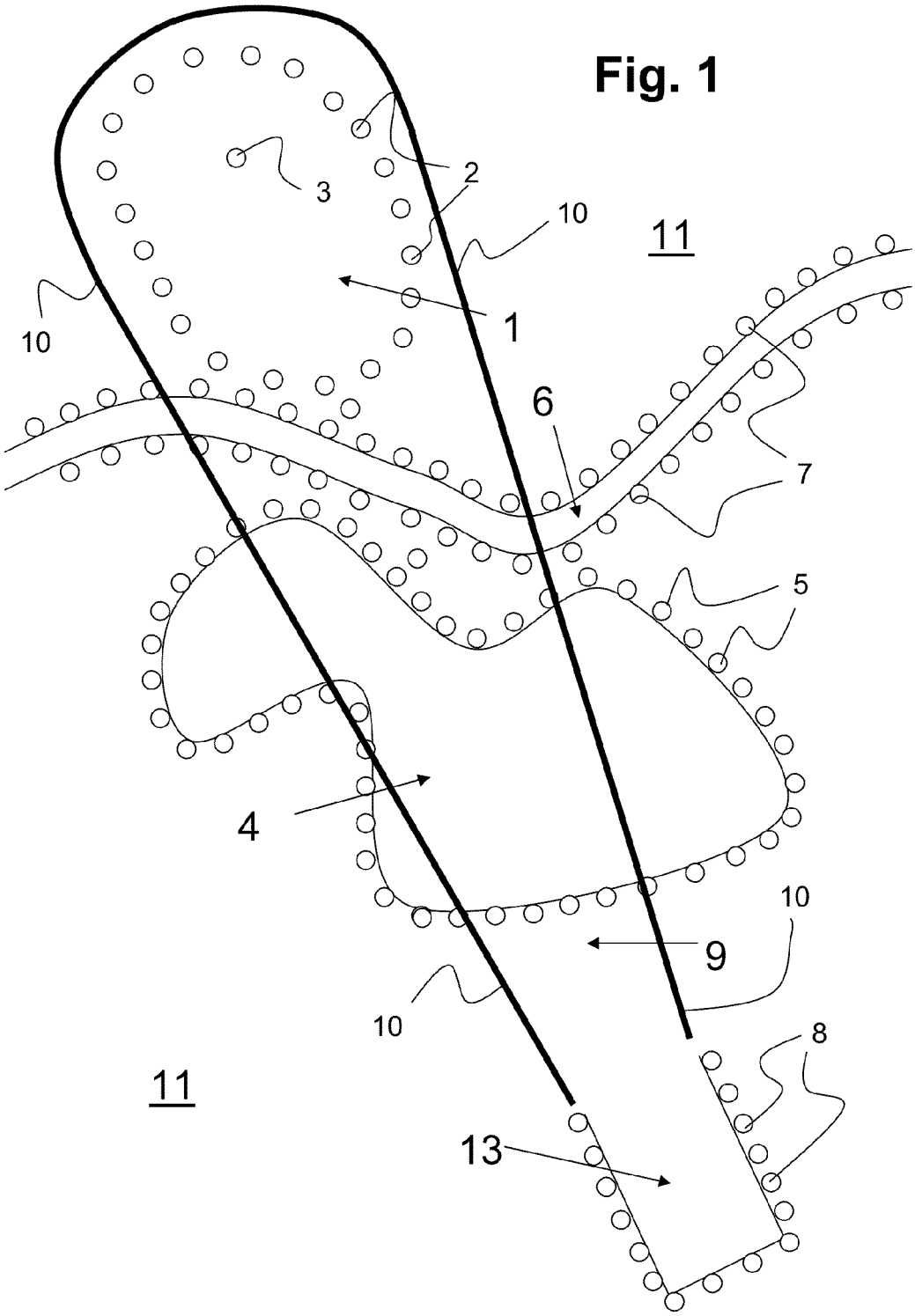
Figure 2:
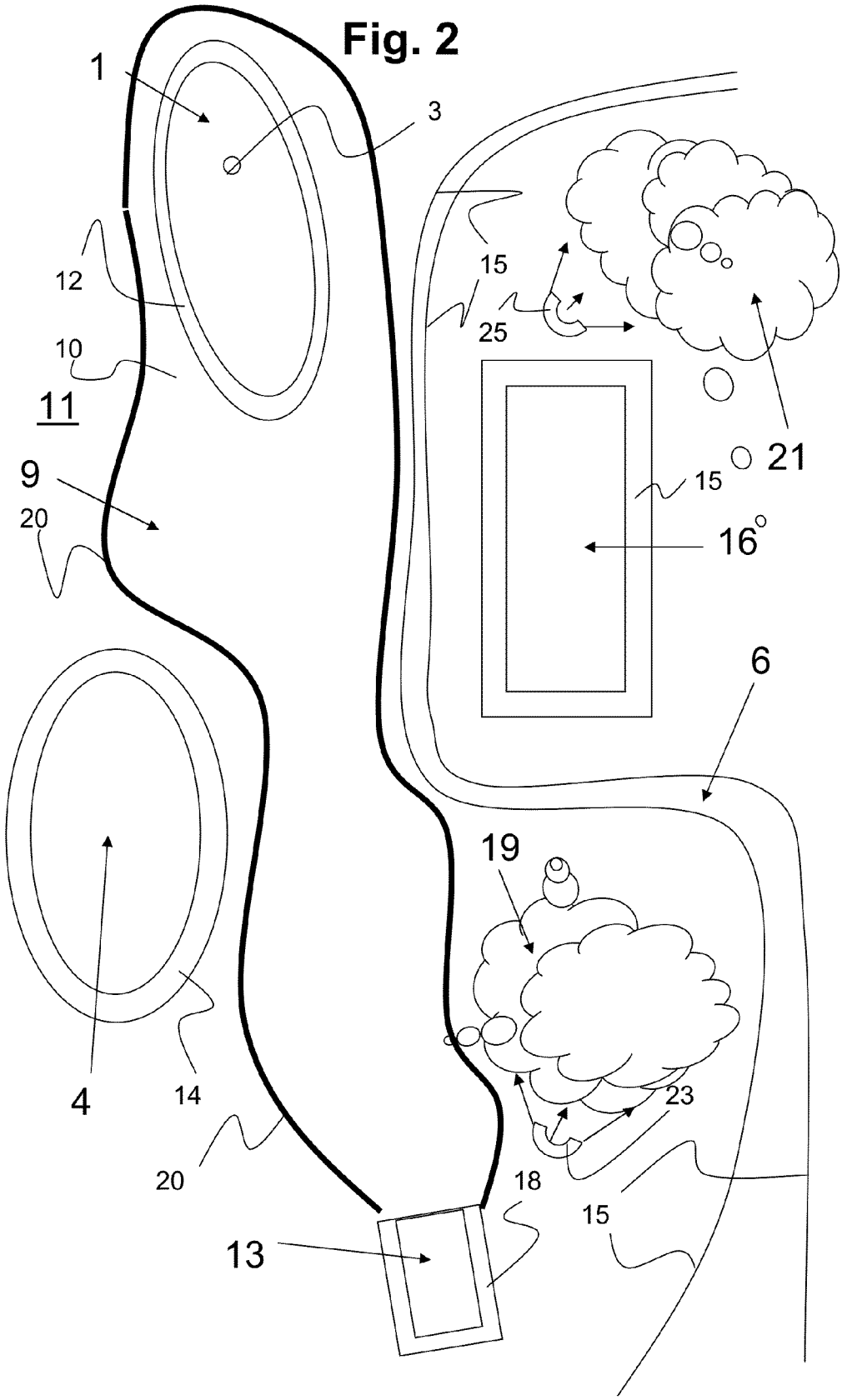
Figure 3:
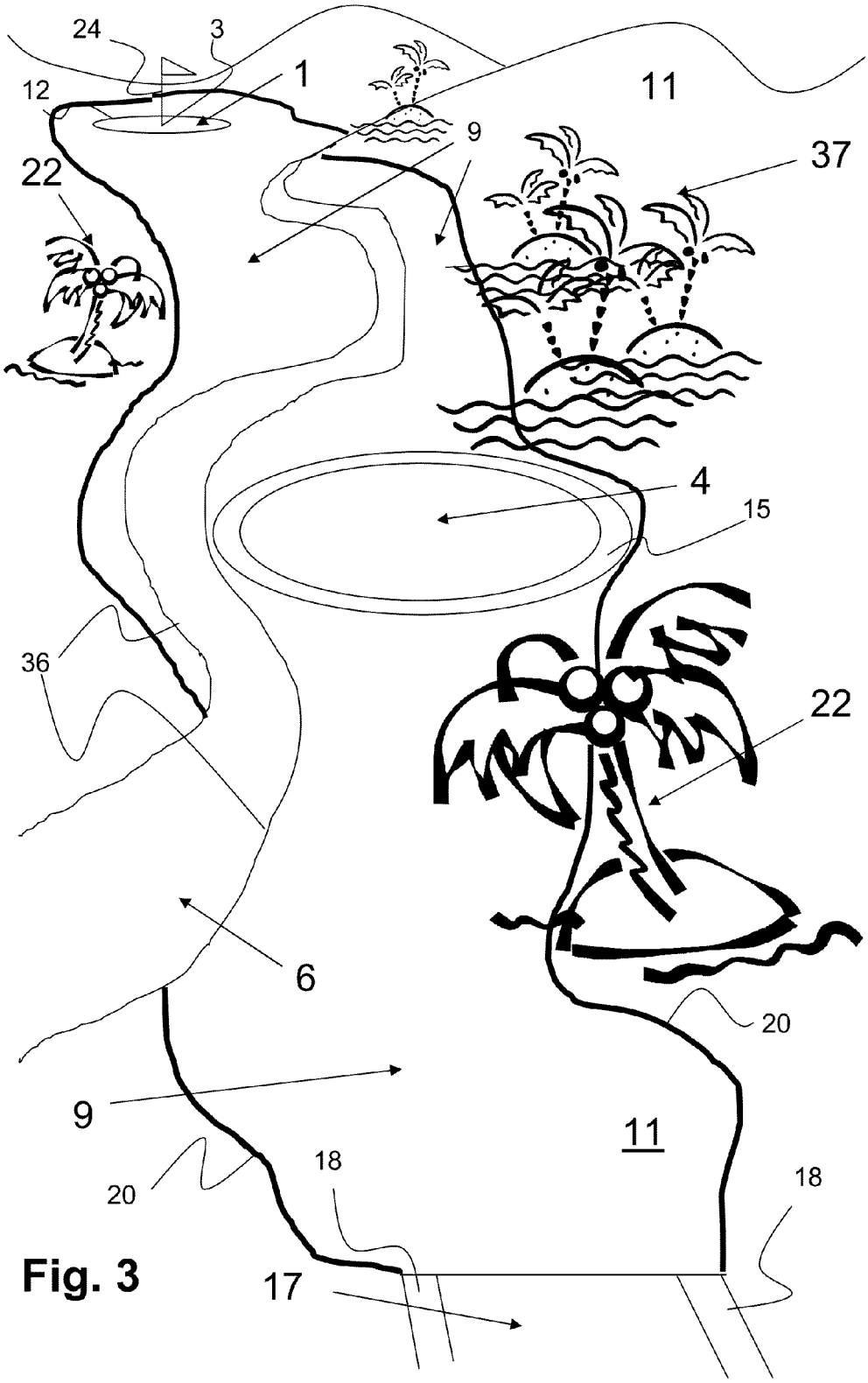
Figure 4:
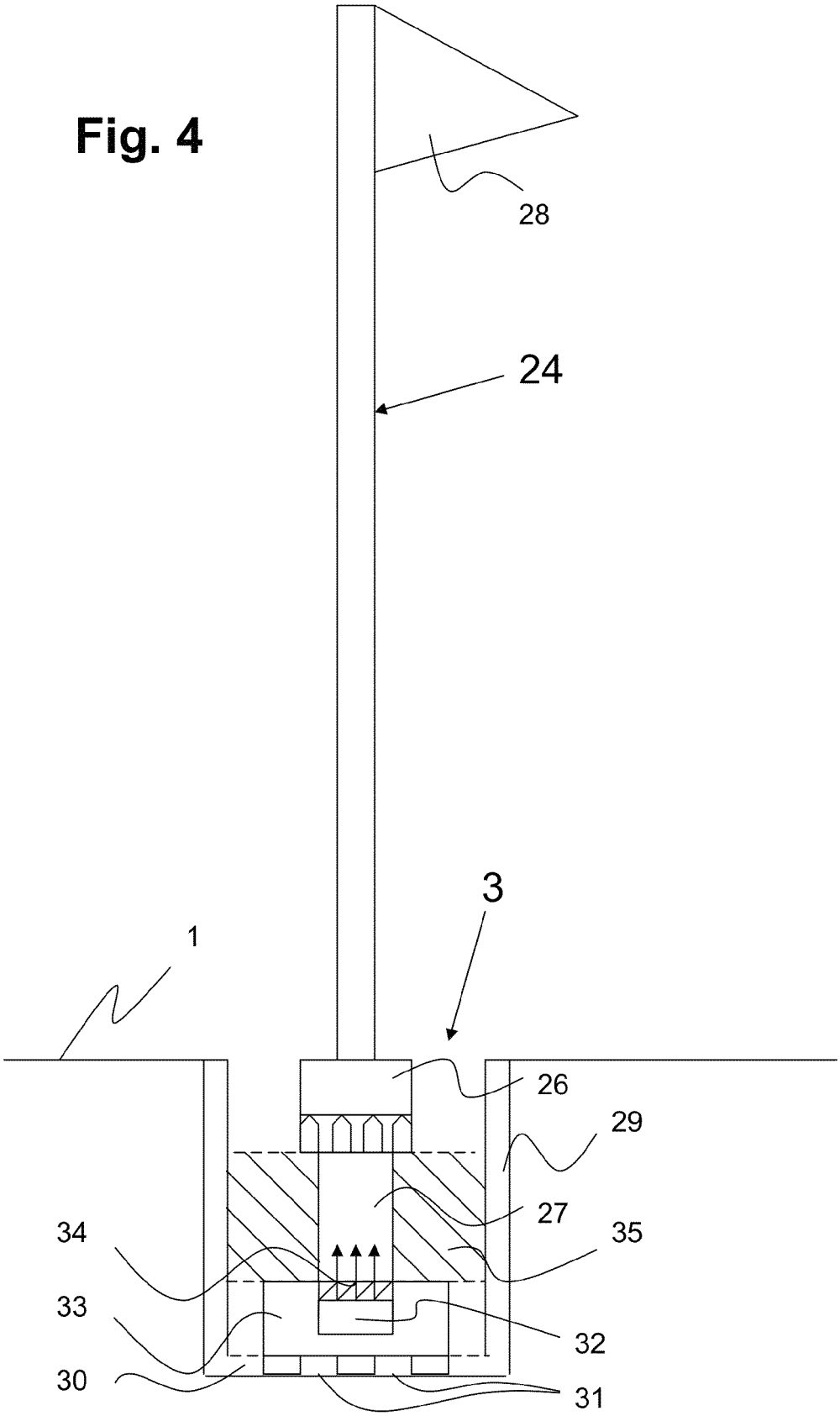
Figure 5:
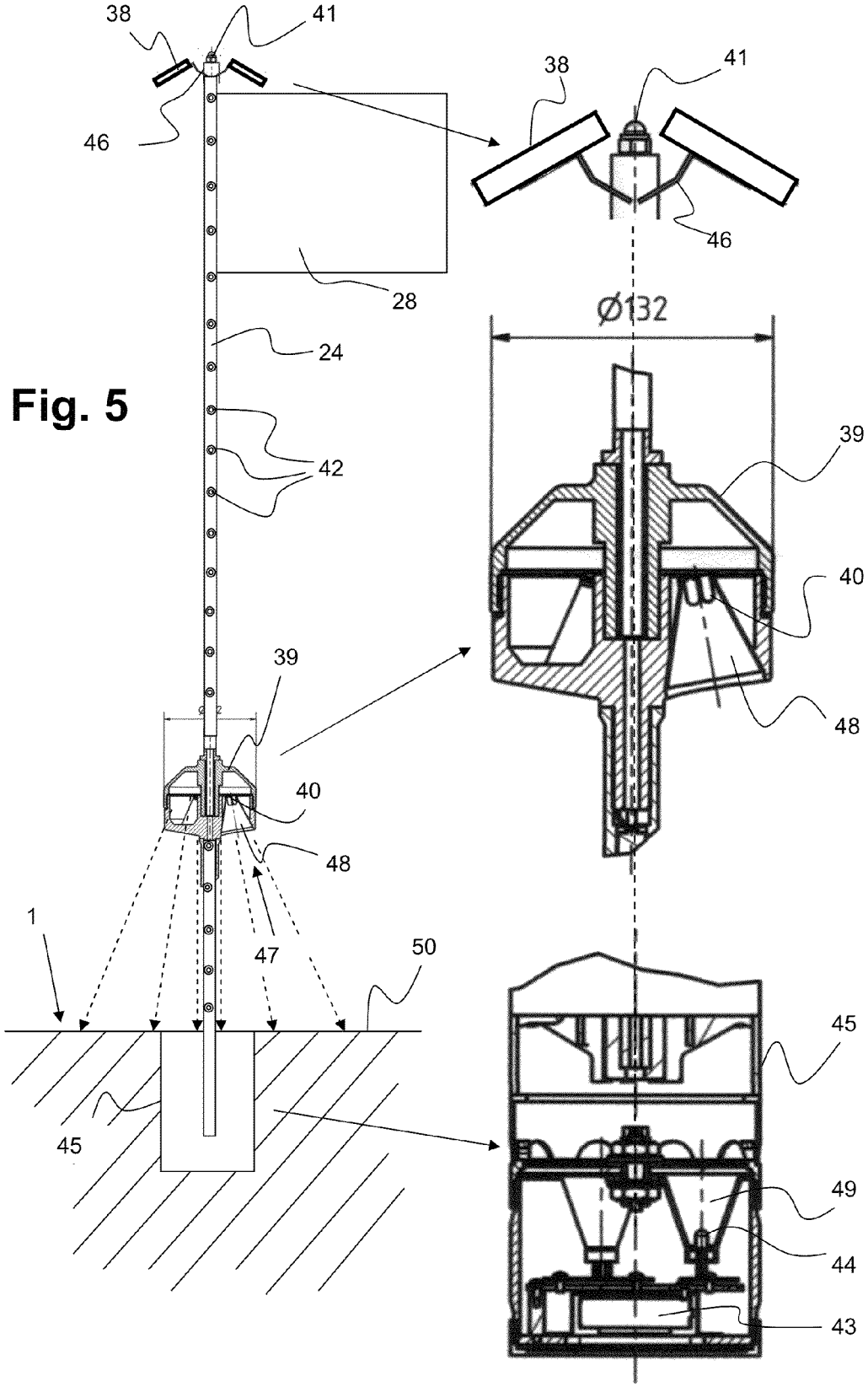

It shows:

FIG. 1 A section of the golf course seen in layout with a teeing ground, a fairway, a green, a bunker and an obstacle, each framed with a discrete light source;

FIG. 2 A section of the golf course seen in layout with a teeing ground, a fairway, a green, a bunker and an obstacle, each framed with a continuous, extensive OLED light source;

FIG. 3 A section of the golf course seen in perspective from the teeing ground;

FIG. 4 A flagpole as a removable illuminating pole with the corresponding illuminated hole for the golf ball;

FIG. 5 An alternative flagpole as a removable illuminating pole with the corresponding illuminated hole for the golf ball.

The basic idea of this invention consists in making a golf course playable in darkness but not in the obvious way with a floodlight system but in an entirely novel way. There are few golf courses which are equipped with a floodlight system, like in Dubai. However, the play is discontinued with the setting in of twilight in most of the golf courses. A floodlight system, at golf courses currently equipped with it, illuminates the entire area of the golf course with a relatively glaring light. It is important to make things, which the players must see, clearly recognisable. As golf courses are extensive by their very nature, the establishment of a floodlight system is correspondingly too expensive and their actual operation is also costly. On one hand high costs are accrued for electrical energy and on the other hand, such a floodlight system is expensive to maintain.

On the contrary, the present invention recommends a golf system which includes a conventional fairway, teeing ground, greens with flagpoles and holes as well as bunkers along with usual obstacles, but where golf can be played at night with less effort. As is evident from FIG. 1, which shows a section of one such golf course in layout; a golf course is equipped with ground recessed lights for this purpose. A brooklet 6 meanders here through fairway 9. As a special feature corresponding to the invention, only the teeing grounds 13, the greens 1, the bunkers 4 and obstacles 6 are equipped with a series of discrete or continuous light sources 2, 5, 7, 8 and 10. These light sources 2, 5, 8 and 10 stretch along the borders of the teeing grounds 13, greens 1, bunkers 4, obstacles 6 and surround the fairway 9. Further the holes 3 in the greens 1 are illuminated internally and the flagpoles are designed to be illuminated from inside as they are hollow and are manufactured from a translucent material so that they can be indirectly illuminated by the hole lights.

In an initial variant, these light sources are individual lamps which are arranged in a row and border the teeing grounds 13, greens 1, bunkers 4, obstacles 6, and surround the fairway 9. The light sources 2, 5, 7, 8 and 10 are thereby flat on the top and are installed in such a way in the fairway 11, that their flat upper side is flush with the fairway 11 and the ground of the fairway 11. Thus a golf ball that rolls over a light source is not disturbed from its course. Ground recessed lights, either equipped with LED lights or with low voltage halogen lamps, are suitable as light sources: The luminous efficiency is basically higher with lower voltage. As the output is $P=U\times I$ and $U=R\times I$ applies, the power can be expressed as $P=U^2/R$. If the voltage of 230V is reduced by a twentieth (by 12 Volts instead of 230 Volts), the power must be increased twentyfold for the same lighting efficiency and the coil resistance of the light must be reduced by 400 times (20×20). That means that a very short and thicker coil can be installed which significantly prolongs the life of the light. A part of the life extension can be transformed into an increase of efficiency and a higher lighting efficiency. Such lights are customary. They are available as compact ground and wall recessed lights for decorative purposes in different variants—round or angular, equipped with Top LEDs or with low voltage halogen lamps. The light fixtures are made of robust, coated cast aluminium and are both walkable and navigable. The rings, frames and fastening screws are made of stainless steel and the seals are made of silicon. The glass covering is made of satinated glass. The ground recessed receptacles are also available in polypropylene. Typical dimensions of such ground recessed lights are approx. 50 mm to 60 mm along the largest diameter and approx. 70 mm in depth. The power supply includes a power component for transformation of 230 Volts of the operational voltage of 12 volts. The typical lighting efficiency is approx. 20 W. These lights are available for lighting in different colours such as blue, amber, red and green. Also, very flat recessed lights are commercially available which have a recess depth of 10 to 15 mm. Naturally, lights with other characteristics can also be installed. They only need to be suitable for installation in the ground, must be really flat and provide sufficient lighting efficiency.

The light sources should radiate light perpendicularly upwards from the ground so that a glare is avoided as far as possible for the players. When the air is humid there will be a "basket" of vertical light beams directed upwards when one looks sideways, these beams converge at a certain height and then disappear into darkness. So that the golf player can differentiate if the objects marked with lights in this way are a golf course related greens 1 or bunkers 4 to be avoided or obstacles 6, where the fairway 9 is and where the teeing grounds are, the light sources 2, 5, 7, 8 and 10 are marked with different colours for these various objects. For example, the greens 1 can be marked with green coloured light sources 2, the bunkers 4 on the contrary with yellow coloured light sources 5, obstacles 6 in the form of ponds or streams or boulders, etc. can be bordered with blue light sources 7. The size of a bunker 4 often measures not more than 60 meters and approx. 30 light sources 5 are sufficient for marking this perimeter. The tees 13 are preferably marked with red coloured light sources 8 so that they are intuitively not alluded to as prohibited zones. A tee 13 normally has a perimeter of 10 m. 5 to 10 light sources 8 are sufficient here, where significantly more light sources can be installed as shown in FIG. 1. The fairways 9 can likewise be marked by a row of white light sources 10 along their borders, if necessary. The fairway 9 is then marked with a chain of lights which extend from the teeing ground to all around the fairway. The distance from the tee 13 to the hole 3 and back is mostly approx. 300-400 m as a 3 par hole distance is approx. 150 to 200 m. For example, 30-40 lights 10 can be installed for production of white light, set in equal intervals for this purpose. It simplifies the estimation of the hole distance for the player.

As an alternative to low voltage halogen lights or LED lights in the ground, a second variant of light sources in the form of OLED lights (OLED=Organic Light Emitting Diode) or even OLED manufactured from polymer can be installed. These are then denoted as PLED. Derivatives of poly(p-phenyl vinyl) (PPV) is often used as colouring in PLEDs. In recent times, dye molecules are used which have four times higher efficiency than with the fluorescent molecules described above. OLEDs can be applied to thin, flexible sheets and emit coloured light. Such OLEDs or PLEDs are likewise installed flush with the fairway or ground and form a seamless, continuous luminous marking in the form of an illuminating belt around the marked objects. The fairways are then marked with an individual, comprehensive belt of OLED lights. An OLED is a thin film, illuminating component from organic, semiconducting materials which are different from the inorganic light diodes (LED) in that the current density and the luminance are lower and no monocrystalline materials are required. In comparison to conventional (inorganic) light diodes, the organic light diodes can be manufactured cost-effectively, their lifetime is however currently lower than any of the conventional light diodes. The OLED technology is currently more suitable for screens (e.g. television, PC screens, monitors) and displays. A further area of application is the ambient lighting of grassy surfaces. Owing to the material properties, OLEDs provide the opportunity to position wafer-thin, transparent coatings as light sources at any place and thus they are suitable to provide a green, a teeing ground, a bay or an obstacle with extensive, continuous light strips which are installed flush with the fairways or the ground. OLED lights are commercially available since 2008, which are denoted as Orbeos and are offered by Osram. The opportunity also exists here to install different coloured light for various objects.

In FIG. 2, a section of a golf course seen in layout is shown, with a teeing ground 13, a fairway 9, a green 1, a bunker 4 and an obstacle in the form of a pond 16 which have all been equipped with such continuous, extensive OLED light sources. The teeing ground 13 is surrounded by a strip light 18 of OLEDs for red light in a U form here. The fairway 9 is framed by a light strip 20 of OLEDs for white light. The green 1 is likewise surrounded by a continuous strip light 12 of OLED, preferably with green light. Also, the bunker 4 and the square-shaped pond 16 are surrounded by a light belt 14, 15. The bunker 4 is preferable surrounded by yellow light and the pond 16 with blue light, by means of which these obstacles are marked and identified clearly. The other obstacles in the form of bushes 19, 21 do not absolutely need to be marked with light as they anyway lie outside the fairway. They can however be illuminated with spotlights 23, 25 for decorative purposes to create a special ambience.

In FIG. 3, a section of a golf course developed in such a manner is shown (in perspective view). This is seen from teeing ground 13. This golf course is equipped with individual palms 22 and palm groups 37. A bunker 4 lies in fairway 9 which is marked with a thick line in the figure. It can be marked with a light strip 20 so that a "road" is formed in the direction of play. A flagpole 24 is inserted in hole 3 whose rod is illuminated from below and lighted up internally, so that the rod can be identified as an illuminating pole from the teeing ground 17. A stream 6 flows through the terrain here and its borders can be marked intermittently or continuously with OLED light strip 36.

The FIG. 4 shows a flagpole 24 as a removable lighting rod. It is composed of a tube made of translucent material which acts like frosted glass. The flagpole 24 has the usual flag 28 on the top. Below, it is inserted onto a plug-in sleeve 26 which has a tapered section below, forming the plain coupler 27. Hole 3 is formed from a cylindrical bush 29. Its bottom 30 has holes 31 so that water penetrating from above can drain into the underground. The light source 32 is installed below at the bottom 30 of the bush 29. The light source is housed in a housing 33 which is closed above with a glass panel 34. A hollow cylindrical, water permeable cup 35 made from a synthetic material is placed on top of the housing 33 of light source 32 and it forms a central cylindrical hole for the plain coupler 27. When the light source 32 illuminates, its light beams radiate into the plain coupler 27 from below as shown with the arrows and they are guided into the inner part of the flagpole 24, where the light diffuses and illuminates the flagpole 24 uniformly. As soon as the ball lands in the vicinity of flagpole 24 when playing, the flagpole 24 is simply taken out of the cup 35 and the light source 32 illuminates the hole 3 where its light radiate upwards and illuminate the internal wall of the bush 29. Thus the hole 3 is now ready so that the ball can be putted into the same hole.

To derive maximum advantage, the holes 3 are designed in such a way their base is formed from an individual light source, i.e. via a ground-recessed light in the form of a LED light, a low voltage halogen lamp or an OLED reflective foil. These lights also illuminate the cylindrical inner wall of the hole 3 after the removal of flagpole 24 and a vertical light beam radiating upwards is created simultaneously.

FIG. 5 shows an alternative, an even better flagpole 24 than the removable illuminating pole and the details are shown in larger scale next to it. This flagpole 24 is composed of a tube made of translucent material which acts like frosted glass. Alternatively any conventional flagpole can be used, which is opaque and holes 42 are provided for light. The flagpole 24 has the usual flag 28 on the top. In contrast to the flagpole as shown in FIG. 4, the upper end of the flagpole 24 has solar panels 38, which use sunlight for the power supply of flagpole lighting and are fixed to the flagpole 24 with a retaining ring 46. Here the flagpole has a perforated design or it has a number of radial holes 42 spread along its length, for example a series of approx. 20 holes as shown here. A further series of such holes 42 are available for each 90° rotation, where these holes 42 are placed somewhat higher when compared to the previous holes, so that the flagpole 24 does not become excessively weak in certain positions. Overall the flagpole 24 has 4×20 holes in the example shown. Light-emitting diodes (LED) are integrated inside the flagpole 24. Thus the flagpole 24, when its internal LEDs are switched on, radiates light in all directions through these holes 42. The LED power supply is via a battery 43 which is installed at the bottom end of the flagpole 24 in its socket 45. LEDs 44 with the related reflectors 49 are also installed in this socket 45 so that light beams that radiate upwards are created. These light beams illuminate the socket wall from inside. Thus the effective hole, consisting of the inside of the socket wall, can be identified well in darkness and the ball can thus be played directed at the hole. Approx. 30 cm above the ground 50 of the greens 1, the flagpole 24 has a round housing 39 which forms a cap. The cap forms an open radial groove 47 below. At least 3 LEDs 40 with the related reflectors 48 are located in this radial groove 47 which radiate their light downwards. The groove also contains a light cone which illuminates the length of the flagpole 24 with its inner side and a radiating cone with a beam angle of approx. 20-30° illuminate downwards. Thus these LEDs 40 illuminate the ground area 50 around the flagpole 24 within a diameter of approx. 30 cm. The flagpole and its exact position is thus recognisable from afar. These LEDs in the flagpole 24 as well as the LEDs 40 in the case front 39 and any LEDs 44 in the socket 45 are switched on and off via a twilight switch 41 which is mounted at the upper end of the flagpole 24.

The flagpole 24 with its socket 45 is designed as a unit so that it can be easily replaced. The holes and thus the flagpoles are regularly moved inside the green, so that the edges of the hole—the grass will wear out at this location—can recover, and these holes are closed with humus plugs with a closing round grass tile. A new hole is cut out at some distance and the flagpole 24 along with its socket 45 as a unit will be inserted into this hole. Thus it is immediately ready for operation in darkness, without requiring any changes or power connections. As soon as the dimmer is triggered, its LEDs are immediately switched on and supplied by the accumulated battery current. As soon as it becomes brighter the LEDs will switch off and the battery will be recharged by the solar panels.

On such a golf course the game is played with an illuminating golf ball. Such balls are already available in the market. Apart from illuminating golf balls, blinking and flashing golf balls are also available for playing on a golf course illuminated with flood lights. For example these balls flash approx. 7 times per second for approx. 6-7 minutes after hitting, where piezoelectric effect is used. Such balls are well suited for playing as suggested here and for night play in a golf course. Furthermore there are also golf balls with a diametric hole, in which an illumination rod can be positively plugged in, which then lights up substantially for 7 to 10 hours.

The system is operated either through solar energy or through conventional electricity. Each system is customised to the respective golf course. Such a night golf course can be created from scratch or an existing course can be changed with such lighting, so that playing is possible even at night. This will extend the playtime in a golf course considerably. In many countries where it is too hot in the evening and it becomes dark earlier, golf can be played for a few more hours and that too in a highly conducive ambience. Overall a golf course equipped in this way is a special sight and creates a romantic and mystical atmosphere, which makes staying and playing on this golf course very attractive. Play can be continued throughout the day as before.

The invention claimed is:

1. A golf course with fairways (11), teeing grounds (7), greens (1) with holes (3) and bunkers (4) and other usual obstacles (6) at which the teeing grounds (13,17), greens (1), bunkers (4), obstacles (6,16), holes (3) and flagpoles (24) are marked with light sources (2,5,7,8,10; 12,15,18,20,36), characterized by the fact that these light sources are a row of discretely laid ground recessed lights which are installed flush with the fairway (11) along borders of the teeing grounds (13,17), greens (1), bunkers (4) and obstacles (6,16) so that the light radiates upwards and the holes to be played are built from a receptacle like socket (45) for ensuring a hole border of grass, a hollow flagpole (24) made of translucent or opaque material is inserted in this socket (45) whereby a battery (43) and at least a light for lighting up the flagpole from outside or illuminating the flagpole from inside is housed on the bottom of the socket (45); and wherein a number of battery (43) supplied light-emitting diodes (LEDs) are housed inside the flagpoles (24), and the flagpoles (24) have multiple rows of holes (42) distributed along the length of the flagpoles.

2. The golf course with fairways (11), teeing grounds (7), greens (1) with holes (3) and bunkers (4) and other usual obstacles (6) according to claim 1, characterized by the fact that the holes (42) on the flagpoles are distributed along the length of the flagpoles for each 90° rotation.

3. The golf course with fairways (11), teeing grounds (7), greens (1) with holes (3) and bunkers (4) and other usual obstacles (6) according to claim 1, characterized by the fact that a number of LEDs (44) with related reflectors (49) for creation of light cones, or low voltage halogen lamps, that radiates upwards are available on the bottom of the socket (45).

4. The golf course with fairways (11), teeing grounds (7), greens (1) with holes (3) and bunkers (4) and other usual obstacles (6) according to claim 1, characterized by the fact that the flagpoles (24) have a case front (39) above the ground (50), the case front is open downwards and has a number of LEDs (40) with related reflectors (48) inside the case front for creation of light beams that radiate downwards for illuminating a ground area directly around the socket (45) of the flagpole.

5. The golf course with fairways (11), teeing grounds (7), greens (1) with holes (3) and bunkers (4) and other usual obstacles (6) according to claim 1, characterized by the fact that the flagpoles (24) have at least a solar panel (38) at their upper end for charging the battery (43) housed in the socket (45) and that the LEDs are switched by a twilight switch (41).

6. The golf course with fairways (11), teeing grounds (7), greens (1) with holes (3) and bunkers (4) and other usual obstacles (6) according to claim 1, characterized by the fact that the holes (3) are illuminated internally by means of a light source (32) in which an OLED or LED light is located at the bottom of the hole and the related flagpole (24) that can be inserted in the hole (3) is hollow and is manufactured from translucent synthetic material so that it diffuses light by means of the OLED or LED light on the bottom of the hole (30).

7. The golf course with fairways (11), teeing grounds (7,17), greens (1) with holes (3) and bunkers (4) and other usual obstacles (6, 16) according to claim 1, characterized by the fact that the flagpoles (24) are manufactured from translucent synthetic material and have a plug-in sleeve (26) with a plain coupler (27) which can be detached and plugged into a cup (35) or socket (45); a light source (32,44) in the form of a LED, OLED, PLED or a low voltage halogen lamp is installed in the hole (3).

8. The golf course with fairways (11), teeing grounds (7,17), greens (1) with holes (3) and bunkers (4) and other usual obstacles (6, 16) according to claim 1, characterized by the fact that the light sources for the teeing grounds (7,17), greens (1) with holes (3) and bunkers (4) and the other usual obstacles (6,16) are each designed with a special color for the light.

9. The golf course with fairways (11), teeing grounds (7,17), greens (1) with holes (3) and bunkers (4) and other usual obstacles (6, 16) according to claim 1, characterized by the fact that the light sources for the teeing grounds (7,17), greens (1) with holes (3) and bunkers (4) and other usual obstacles (6, 16) are each designed with a special color for the light, as the greens (1) are provided with green light sources (2,12), the bunkers (4) with yellow light sources (5,14), the water obstacles with blue light sources (7,15,36), the teeing grounds (7,17) with red light sources (8,18) and the fairways (9) with white light sources (10,20).

10. A golf course with fairways (11), teeing grounds (7), greens (1) with holes (3) and bunkers (4) and other usual obstacles (6) at which the teeing grounds (13,17), greens (1), bunkers (4), obstacles (6,16), holes (3) and flagpoles (24) are marked with light sources (2,5,7,8,10; 12,15,18,20,36), characterized by the fact that the light sources are a row of discretely laid ground recessed lights which are installed flush with the fairway (11) along borders of the teeing grounds (13,17), greens (1), bunkers (4) and obstacles (6,16) so that the light radiates upwards and the holes to be played are built from a receptacle like socket (45) for ensuring a hole border of grass, a hollow flagpole (24) made of translucent or opaque material is inserted in the socket (45) whereby a battery (43) and at least a light for lighting up the flagpole from outside or illuminating the flagpole from inside is housed on the bottom of the socket (45); and wherein the flagpoles (24) have a case front (39) above the ground (50), the case front is open downwards and has a number of light-emitting diodes (LEDs) (40) with related reflectors (48) inside the case front for creation of light beams that radiate downwards for illuminating a ground area directly around the socket (45) of the flagpole.

11. The golf course according to claim 10, characterized by the fact that a number of LEDs (44) with related reflectors (49) for creation of light cones, or low voltage halogen lamps, that radiates upwards are available on the bottom of the socket (45).

12. The golf course according to claim 10, characterized by the fact that the flagpoles (24) have at least a solar panel (38) at their upper end for charging the battery (43) housed in the socket (45) and that the LEDs are switched by a twilight switch (41).

13. The golf course according to claim 10, characterized by the fact that a number of LEDs are housed inside the flagpoles (24), and the flagpoles have multiple rows of holes (42) distributed along the length of the flagpoles.

14. The golf course according to claim 13, characterized by the fact that the case front (39) further includes a light cone to illuminate a length of the flagpole.

15. The golf course according to claim 10, characterized by the fact that the flagpoles (24) are made of a translucent material and have a plug-in sleeve (26) with a plain coupler (27) which can be detached and plugged into a cup (35) or socket (45); and a light source (32,44) in the form of a LED, OLED, PLED or a low voltage halogen lamp is installed in the hole (3).

16. The golf course according to claim 10, characterized by the fact that the light sources for the teeing grounds (7,17), greens (1) with holes (3) and bunkers (4) and the other usual obstacles (6,16) have colored light.

17. A golf course with fairways (11), teeing grounds (7), greens (1) with holes (3) and bunkers (4) and other usual obstacles (6) at which the teeing grounds (13,17), greens (1), bunkers (4), obstacles (6,16), holes (3) and flagpoles (24) are marked with light sources (2,5,7,8,10; 12,15,18,20,36), characterized by the fact that the light sources are a row of discretely laid ground recessed lights which are installed flush with the fairway (11) along borders of the teeing grounds (13,17), greens (1), bunkers (4) and obstacles (6,16) so that the light radiates upwards and the holes to be played are built from a receptacle like socket (45) for ensuring a hole border of grass, a hollow flagpole (24) made of translucent material is inserted in the socket (45) whereby a battery (43) and at least a light for lighting up the flagpole from outside or illuminating the flagpole from inside is housed on the bottom of the socket (45); wherein the holes (3) are illuminated internally by means of a light source (32) in which an OLED or LED light is located at the bottom of the hole and the flagpoles (24) diffuses light generated by the OLED or LED light on the bottom of the hole (30).

18. The golf course according to claim 17, characterized by the fact that the flagpoles (24) have a plug-in sleeve (26) with a plain coupler (27) which can be detached and plugged into a cup (35) or socket (45); a light source (32,44) in the form of a LED, OLED, PLED or a low voltage halogen lamp is installed in the hole (3).

19. The golf course according to claim 17, characterized by the fact that the flagpoles (24) have at least a solar panel (38) at their upper end for charging the battery (43) and that the LEDs are switched by a twilight switch (41).

20. The golf course according to claim 17, characterized by the fact that the light sources for the teeing grounds (7,17), greens (1) with holes (3) and bunkers (4) and the other usual obstacles (6,16) have colored light.

* * * * *